US009316024B2

(12) United States Patent
Münger et al.

(10) Patent No.: US 9,316,024 B2
(45) Date of Patent: Apr. 19, 2016

(54) MECHATRONIC LOCKING DEVICE

(75) Inventors: Andreas Münger, Jona (CH); Bruno Vonlanthen, Schänis (CH)

(73) Assignee: ASSA ABLOY (SCHWEIZ) AG, Richterswil (CH)

( * ) Notice: Subject to any disclaimer, the term of this patent is extended or adjusted under 35 U.S.C. 154(b) by 224 days.

(21) Appl. No.: 14/241,514

(22) PCT Filed: Aug. 23, 2012

(86) PCT No.: PCT/EP2012/066406

§ 371 (c)(1),
(2), (4) Date: Jun. 25, 2014

(87) PCT Pub. No.: WO2013/030078

PCT Pub. Date: Mar. 7, 2013

(65) Prior Publication Data

US 2014/0298870 A1 Oct. 9, 2014

(30) Foreign Application Priority Data

Aug. 29, 2011 (EP) ..... 11179158

(51) Int. Cl.
*E05B 47/00* (2006.01)
*E05B 47/06* (2006.01)
(Continued)

(52) U.S. Cl.
CPC ..... *E05B 47/0001* (2013.01); *E05B 47/0611* (2013.01); *E05B 49/002* (2013.01); *G07C 9/00174* (2013.01); *G07C 9/00309* (2013.01); *G07C 9/00714* (2013.01); *E05B 2047/005* (2013.01); *E05B 2047/0088* (2013.01); *G07C 2009/00761* (2013.01);
(Continued)

(58) Field of Classification Search
None
See application file for complete search history.

(56) References Cited

U.S. PATENT DOCUMENTS

2012/0011907 A1 1/2012 Sprenger et al.

FOREIGN PATENT DOCUMENTS

| | | | |
|---|---|---|---|
| CH | 700674 | A1 | 9/2010 |
| CN | 201771284 | U | 3/2011 |
| DE | 2020373 | A1 | 11/1971 |
| DE | 3940737 | A1 | 6/1991 |

(Continued)

OTHER PUBLICATIONS

"Hardwired Jumper Key-Keylock", IBM Technical Disclosure Bulletin, International Business Machines, Corp., Bd. 37, Nr. 12, Dec. 1, 1994.

European Search Report: PCT/EP2012/066406, Sep. 26, 2012.

*Primary Examiner* — Daniell L Negron
(74) *Attorney, Agent, or Firm* — Browdy and Neimark, PLLC

(57) ABSTRACT

The invention relates to a mechatronic locking device comprising: a locking cylinder having a control circuit and a security key associated with the locking cylinder having a memory circuit, wherein informational signals can be exchanged between the control circuit of the locking cylinder and the memory circuit of the security key via a communication channel, wherein the security key further comprises a contact element which is connected to the memory circuit of the security key via a contact section integrated on the security key, wherein the locking cylinder further comprises a contact element which is connected to the control circuit of the locking cylinder, wherein the contact elements are electrically in contact to each other when the security key is inserted and wherein said communication channel conducts between the control circuit and the memory circuit via the contact section integrated in the security key and the two contact elements.

14 Claims, 3 Drawing Sheets

(51) Int. Cl.
*G07C 9/00* (2006.01)
*E05B 49/00* (2006.01)

(52) U.S. Cl.
CPC ..... *G07C 2009/00777* (2013.01); *G07C 2009/00793* (2013.01); *Y10T 70/7791* (2015.04)

(56) References Cited

FOREIGN PATENT DOCUMENTS

| | | | | |
|---|---|---|---|---|
| DE | 4036575 | A1 | | 6/1991 |
| JP | 07075174 | A | * | 3/1995 |

* cited by examiner

MECHATRONIC LOCKING DEVICE

TECHNICAL FIELD

The present invention relates to a mechatronic locking device as claimed in claim 1.

PRIOR ART

Patent application CH 00500/09 describes a security key that can communicate with a read device via a first communication channel, and with a cylinder of a lock via a second communication channel. The data stored on the key can be used via both communication channels. Thus there are two differently implemented communication paths, one from the key to the reader, the other from the key to the cylinder.

Although the application according to CH 00500/09 is very promising, there is a need to have a more secure design for the communication paths and to provide communication paths that can communicate at a higher data rate.

In addition, systems are known that permit a communication channel between the lock cylinder and key. The key here comprises an RFID chip, which communicates via an over-air radio link with a corresponding receiver in the lock cylinder. The disadvantage with this solution is the fact that communication through metals, so for instance through an armor plate, is associated with numerous data transmission problems. In particular, problems often occur for data transmission at 13.56 MHz.

Proceeding from this prior art, the object of the invention is to define a mechatronic locking system that permits a higher data transfer rate in the communication between key and cylinder.

Such an object is achieved by the subject matter of claim 1. According to said claim, a mechatronic locking device comprises a locking cylinder having a control circuit, and a security key that belongs to the locking cylinder and has a memory circuit. Information signals can be transferred between the control circuit of the locking cylinder and the memory circuit of the security key via a communication channel. The security key further comprises a contact element which is connected to the memory circuit of the security key via a contact path integrated on the security key. The locking cylinder further comprises a contact element, which is connected to the control circuit of the locking cylinder, wherein, with the security key inserted, the contact elements are electrically in contact with one another, wherein information signals can be transferred between key and lock via this contact. Said communication channel between the memory circuit and the control circuit runs via the contact path integrated in the security key and via the two contact elements. The integrated contact path on the security key has a first path segment, which is electrically connected to the memory circuit, which is a chip for instance, and has a second path segment, which adjoins the first path segment and is electrically connected to the contact element. Both path segments are equipped with elements for providing a radio link between the first path segment and the second path segment. Thus a connection into the locking cylinder can be created by the contact elements and the integrated contact path, so that the communication link between security key and locking cylinder is not negatively affected by the environment in which the locking cylinder is fitted. Thus the key comprises a radio transmission path which is integrated in the key and can be used to transfer data easily between the control circuit and the memory circuit.

Hence the locking cylinder can also be used in doors which, because of numerous metallic elements such as armor plates, can usually only be operated with electronic communication elements at a low data transfer rate. Thus a higher data transmission rate is also permitted because the transmission is not affected by said metallic components.

The elements for the radio transmission path or the radio link are preferably a resonant circuit comprising capacitor and inductor, which are usually arranged in parallel with one another. A serial arrangement is also possible.

The second path segment is preferably an electrically conducting physical connection between the elements for the radio link to the contact element.

The memory circuit of the security key preferably comprises a chip, in particular an RFID chip, particularly preferably an RFID ISO 14443A tag, having an associated resonant circuit. The resonant circuit provides the first path segment of the contact path and the elements for the radio link. The control circuit of the locking cylinder preferably comprises a chip, in particular an RFID chip, having an associated resonant circuit, wherein parts of said resonant circuit are arranged on the security key and are electrically connected to the contact element of the security key via the electrically conducting physical path, wherein said parts arranged on the security key provide the second path segment of the contact path and the elements for the radio link. With the security key inserted, the two contact elements are electrically in contact with one another, whereby data can be transferred between the security key and the locking cylinder via the resonant circuits. Hence with the security key inserted, the resonant circuit of the locking cylinder, which circuit is split between cylinder and key, is closed.

The resonant circuit of the memory circuit of the security key preferably comprises a capacitor and an inductor, wherein capacitor and inductor are arranged on the security key, and the resonant circuit of the control circuit of the locking cylinder preferably comprises a capacitor and an inductor, wherein the inductor is arranged on the security key in the region of the inductor of the resonant circuit of the memory circuit of the security key. The capacitor is preferably arranged in the locking cylinder, wherein with key inserted, the resonant circuit is closed via the contact elements.

Alternatively, the capacitor of the resonant circuit of the locking cylinder can also be arranged on the security key, whereby the essential parts of the resonant circuit of the locking cylinder, or more precisely of the corresponding chip, are arranged on the security key.

The two inductors are arranged on the key at a small separation apart, preferably at a separation of 0 to 10 mm, particularly preferably at a separation of 0.05 to 5 mm. The two inductors can have a DC-isolated or DC-coupled design.

The memory circuit of the security key has at least one further communication channel, wherein the further communication channel can be connected to a control circuit of a further device, in particular of a read/write device, preferably by radio transmission via an air interface. The arrangement of the radio transmission path thus also has the advantage that it can also be used for communication with other devices via further communication channels.

The dependent claims define further embodiments.

SHORT DESCRIPTION OF THE DRAWINGS

Preferred embodiments of the invention are described below with reference to the drawings, which are intended solely for explanation and shall not be interpreted as restrictive, and in which.

DESCRIPTION OF PREFERRED EMBODIMENTS

Figure 1:
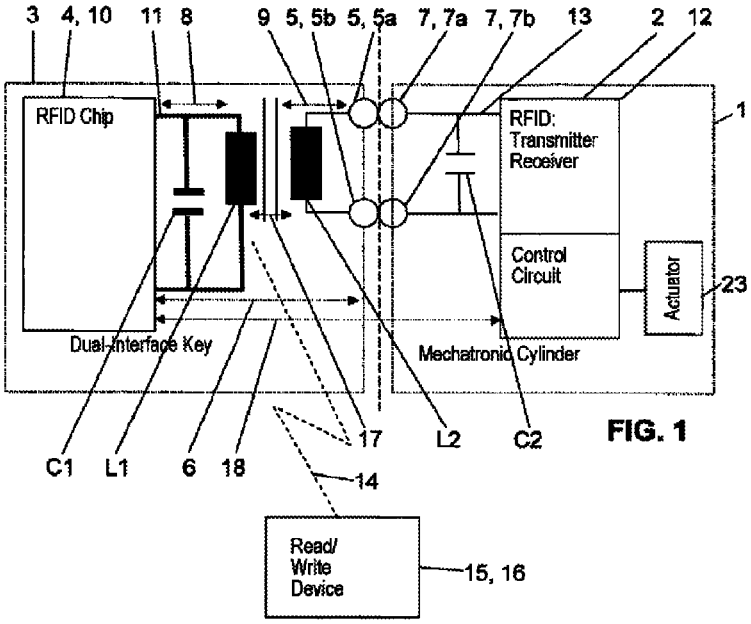
FIG. 1 shows a schematic view of a mechatronic locking system according to the present invention.
Figure 2:
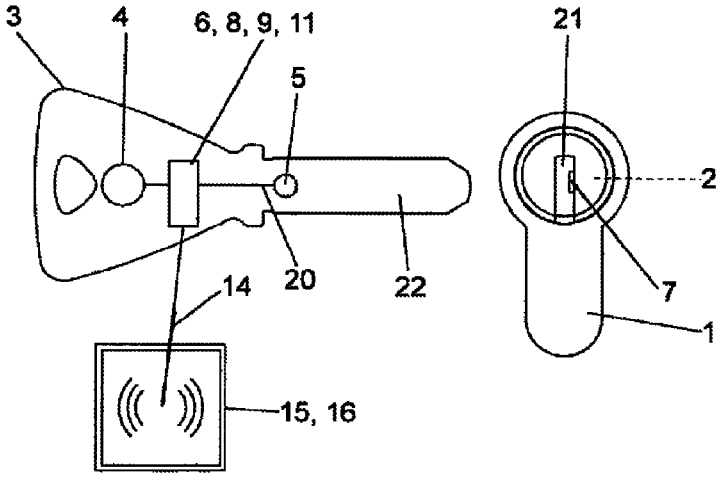
FIG. 2 shows a further schematic view based on the locking system of FIG. 1.

FIGS. 1 and 2 show in a schematic view a mechatronic locking system according to the present invention.

The mechatronic locking device mainly comprises a locking cylinder 1 and an associated security key 3, which can be used to operate the locking cylinder 1. The security key 3 can here be inserted into the locking cylinder 1, as is described further below. The locking cylinder 1 is preferably a locking cylinder having mechanical and/or electronic or electrical locking elements, so that the locking cylinder 1 can be operated by the key only when the mechanical security features between cylinder 1 and key 3 match and/or when the electronic security features between cylinder 1 and key 3 match. In other words, when the corresponding features relevant to access authorization match. Thus in one embodiment, the key 3 can comprise just an electronic or electrical security feature, wherein the part of the key that extends into the lock is then largely used for the mechanical operation of the lock. This can be referred to as an electronic or electrical bolt. In another embodiment, the key comprises mechanical and electronic or electrical security features, wherein both security features are provided for operating the lock. This is referred to as a mechanical and electronic or electrical bolt. Alternatively, other data such as, for instance, time of access, programming data etc. can also be transferred by means of the electronics. In addition, a power supply can also be provided via the electronics.

The locking cylinder 1 comprises a control circuit 2, which can be supplied with electrical power by a battery (not shown here), for example, or by a permanently installed cable. The control circuit 2 can be embodied as a chip.

The security key 3, referred to below also as the key 3, comprises a memory circuit 4. The memory circuit 4 of the security key 3 is here connected via a communication channel 18 to the control circuit 2 of the locking cylinder 1 when the key 3 is in the inserted position in the cylinder 1. In this case, information signals or data can be transferred between cylinder 1 and key 3 via the communication channel 18. The information signals may be, for example, authorization or identification information assigned to the key 3.

The security key 3 further comprises a contact element 5, which is connected to the memory circuit 4 of the security key 3 via a contact path 6 integrated on the security key 3. The contact element 5 here has two contact points 5*a*, 5*b*. The information signals or data can be transmitted from the memory circuit 4 to the contact element 5 via the integrated contact path 6. The integrated contact path 6 is preferably physically formed by means of further parts, as is explained below with reference to FIG. 1.

Likewise, the locking cylinder 1 further comprises a contact element 7, which is connected to the control circuit of the locking cylinder 1, and, with security key 3 inserted, can be connected to the memory circuit 4 of the security key 3 via the contact element 5. Hence the contact element 5 of the key 3 is connected in an electrically conducting manner to the contact element 7 of the cylinder 1 when the key 3 is in the inserted position in the cylinder 1. Also in this case, the contact element 7 comprises two contact points 7*a* and 7*b*, which are arranged similarly to the two contact points 5*a*, 5*b*.

The control circuit 2 and the memory circuit 4 are used in particular for storing and processing access data. The access data can enter the system in a variety of ways. For example, it is possible to provide the memory circuit 4 of the key 3 with relevant data, which is then stored by the memory circuit. This is explained in greater detail below.

If now the key 3 is in the inserted position in the cylinder 1, the contact element 5 of the key 3 is electrically in contact with the contact element 7 of the cylinder. Said communication channel 18 thus runs via the integrated contact path 6 in the key 3 and via the two contact elements 5, 7 to the locking cylinder 1. Providing such a communication channel 18 has the advantage that a solid electrical connection exists between the key 3 and the cylinder 1. Hence the information signals are transmitted via a physical connection from key 3 to cylinder 1, thereby enabling a transmission of the data at a higher data rate than in a radio transmission, for example. The communication channel 18, which comprises the radio transmission path 17, thus provides a direct and physical path between the interface from the key to the locking cylinder 1, whereby the door can have any design, unlike the situation for radio solutions. In addition, the door in which the cylinder 1 is arranged can be provided in the region of the cylinder with reinforcing elements such as, for instance, an armor plate, without impairing the communication between cylinder 1 and key 3.

FIG. 1 is now used to help describe in detail the communication channel 18.

The contact path 6 which is integrated in the key 3 and located on or in the security key 3 here has two path segments 8, 9. The first path segment 8 is electrically in contact with the memory circuit 4 of the key 3. The second path segment 9 is electrically in contact with the contact element 5 and adjoins the first path segment 8. Hence the two path segments 8, 9 connect the memory circuit 4 to the contact element 5. Both path segments 8, 9 have elements for providing a radio link or a radio transmission path 17 between the first path segment 8 and the second path segment 9.

Said means are preferably one capacitor C1, C2 and one inductor L1, L2 in each case, which is described in greater detail further below.

The second path segment 9 is an electrical conducting physical path 9 between said elements for providing the radio link or the radio transmission path 17. The second path segment 9 can also be referred to as a contact-based path segment. The second path segment 9 is here preferably integrated entirely into the key 3 and accessible from outside via the contact element 5.

Hence the information signals are transmitted from the memory circuit 4 to the contact element 5 via the integrated contact path 6, which is composed of the two path segments 8, 9 and is connected to the memory circuit 4. The data is then transferred from the contact element 5 via the contact element 7 of the control circuit 2 of the cylinder 1. Hence there exists between key 3 and cylinder 1 a physical connection via which the data are transferred, which brings the advantages described above. At the same time by means of the radio link on the key, the memory circuit 4 can be designed from simple electronic elements that additionally can also enable further communication channels.

The memory circuit 4 of the security key 3 preferably comprises a chip 10, which can be an RFID chip 10 for instance, and a resonant circuit 11 connected to the chip 10. The resonant circuit 11 here provides the first path segment 8 of the contact path 6 integrated into the key 3, and the elements for the radio link or radio transmission path 17.

The control circuit 2 of the locking cylinder 1 preferably likewise comprises a chip 12 having the associated resonant circuit 13, which is assigned to the locking cylinder 1. The chip 12 can here be embodied as a read/write device. In addition, the chip 12 can be connected to an electrical locking element or an actuator 23 in the locking cylinder 1, and can unlock same when the authorization information is present. Parts of said resonant circuit 13 are arranged on the key 3 in this case. Hence the control circuit 2 is thus connected to the actuator 23. In other words, the resonant circuit 13 can also be said to have a split design, wherein parts are arranged on the key 3 and parts are arranged in the cylinder 1. The parts arranged on the key 3 provide the second path segment 9 of the contact path 6 and the elements for the radio link, and are electrically connected to the contact element 5 of the key 3 via the electrically conducting physical path 9. With key 3 inserted into the cylinder 1, the two contact elements 5, 7 are in contact with one another and thus close the resonant circuit 13 of the cylinder, whereby the data can be transferred between the resonant circuit 12 on the key and the second resonant circuit 13.

The resonant circuit 11, which is connected to the chip 10 of the key 3, comprises a capacitor C1 and an inductor L1, which are both arranged on the security key 3. Capacitor C1 and inductor L1 are electrically connected to the chip 10 and are connected in parallel with one another in this case. Alternatively, the circuit can also have a series design.

The resonant circuit 13, which is electrically connected to the chip 12 of the cylinder 1, comprises a capacitor C2 and an inductor L2. In the present embodiment, the inductor L2 is arranged on the key 3, and the capacitor C2 is arranged in the cylinder. The inductor L2 is in this case arranged in the region of the inductor L1 of the resonant circuit 11 of the key 3. The inductor L2 here provides an element for providing the radio link 17 between the first path segment 8 and the second path segment 9. With key 3 inserted, the resonant circuit 13 is closed via the contact elements 5, 7, whereby data can be transferred between security key 3 and the locking cylinder 1. An electrical connection thereby exists between resonant circuit 13 and chip 12.

The information signals are thus transmitted from the key 3 to the cylinder 1 via the resonant circuit 11 and the resonant circuit 13. Hence the resonant circuit 11 of the key 3 couples information signals into the resonant circuit 13 of the cylinder 1, or the resonant circuit 13 of the cylinder 1 couples information signals into the resonant circuit 11 of the key 3.

Alternatively, the capacitor C2 could also be arranged on the key in addition to the inductor L2, wherein the capacitor C2 and the inductor L2 are connected to one another in parallel and/or in series and are connected to the contact element 5. This embodiment can be used in particular for keys of a larger overall size.

The two inductors L1 and L2 on the key are preferably arranged at a small separation apart so that the losses over the radio transmission path 17 are minimized and the key has a small overall size. A close separation is preferably understood to mean a separation of 0 to 10 mm, particularly preferably at a separation of 0.05 to 5 mm.

In addition, the control circuit 2 of the security key 1 can have at least one further communication channel 14. The further communication channel 14 is in this case a communication channel that is arranged in addition to the communication channel 18 described above. Data transfer with a further device, in particular a read/write device 16 that comprises a control circuit 15, can take place via the further communication channel 14. Thus data can be transferred between locking cylinder 1 and key 3 via the communication channel 18, and also data can be transferred between the key 3 and the further device 16 via the further communication channel 16.

The further communication channel 14 is preferably a radio transmission path or air interface 14. The air interface 14 is provided here from the chip 10 to the read/write device 16. In this case, the chip 10 can be connected to a further resonant circuit, which likewise comprises a capacitor and an inductor. In other words, the control circuit 2 can also be said then to comprise on the security key 1 two antennas, i.e. two inductors L1, L3, one inductor L1 of which is assigned to the communication channel 18, and the other inductor L3 of which is assigned to the further communication channel 14.

Alternatively, the resonant circuit 11 described above can also be used for communication with the further device 16.

The memory circuit 4 of the key or of the RFID chip can be supplied with information such as access data via the further device 16 and also via the control circuit 2.

FIG. 2 shows a further schematic representation of the present invention, in which the physical design of the key 3 and the locking cylinder 1 are shown. On the security key 3 are located the circuit parts described above, i.e. the memory circuit 4 and the integrated contact path or the chip 10 and the resonant circuit 11 and parts of the resonant circuit 13. The contact 7 on the locking cylinder 1 is in this case located in the region of the keyhole 21. The key bit 22, which is used to open mechanically the locking cylinder 1, can also be seen clearly here.

Figure 3:
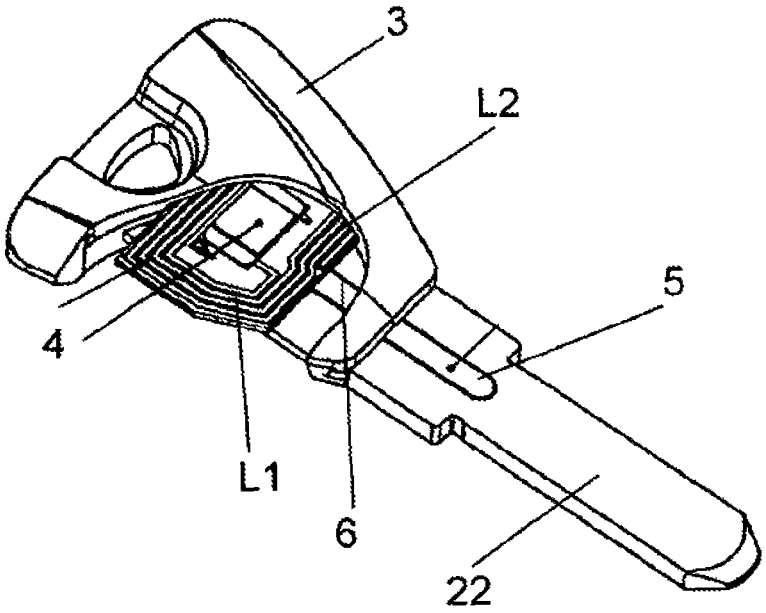
FIG. 3 shows a first cutaway view of a security key for use in the mechatronic locking system.
Figure 4:
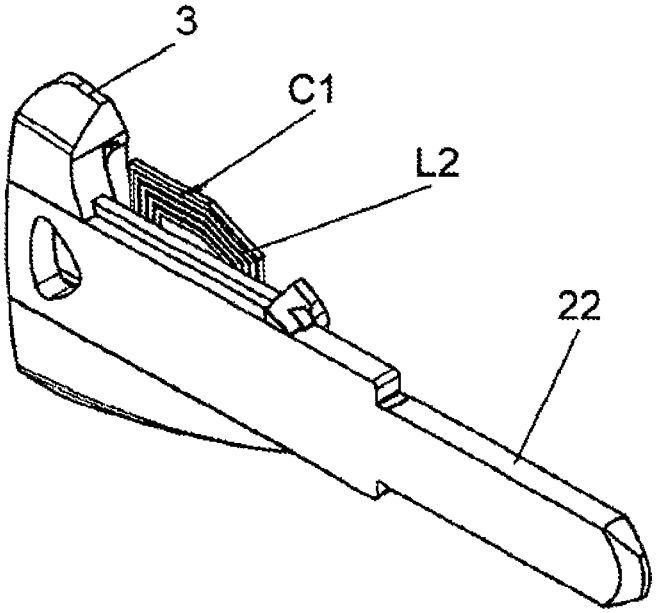
FIG. 4 shows a second cutaway view of the security key according to FIG. 3.

FIGS. 3 and 4 show a perspective view of the key 3 shown in FIG. 2. The inductor L1 can be seen particularly clearly here. The inductor L1 can be designed here such that it serves both as an element for the radio transmission path 17 between the two resonant circuits and for the radio transmission path 14 to the read/write device 16. Hence the same chip 10 can supply two resonant circuits with data, namely the resonant circuit that communicates with the cylinder and the resonant circuit that communicates with the further device 16.

In summary, it can be stated that the invention has the advantage that by splitting up the one resonant circuit, the device can be operated independently of the design of the door, and in particular can also be used for doors comprising numerous metallic elements such as armor plates. At the same time communication with further read devices is facilitated via the memory circuit 4 of the key 3.

LIST OF REFERENCES

1 locking cylinder
2 control circuit
3 security key
4 memory circuit
5 contact element
5*a* contact point
5*b* contact point
6 integrated contact path
7 contact element
7*a* contact point
7*b* contact point
8 first path segment
9 second path segment, physical path
10 chip
11 resonant circuit
12 chip
13 resonant circuit
14 further communication channel, air interface

15 control circuit
16 further device, read/write device
17 radio transmission path
18 communication channel
20 connecting lines
21 keyhole
22 key bit
C1 first capacitor
C2 second capacitor
L1 first inductor
L2 second inductor

The invention claimed is:

1. A mechatronic locking system comprising a locking cylinder having a control circuit, and a security key that belongs to the locking cylinder and has a memory circuit, wherein information signals can be transferred between the control circuit of the locking cylinder and the memory circuit of the security key via a communication channel, wherein the security key further comprises a contact element which is connected to the memory circuit of the security key via a contact path integrated on the security key, wherein the locking cylinder further comprises a contact element, which is connected to the control circuit of the locking cylinder, wherein, with the security key inserted, the contact elements are electrically in contact with one another, wherein said communication channel between the control circuit and the memory circuit runs via the contact path integrated in the security key and via the two contact elements, and wherein the integrated contact path on the security key has a first path segment, which is electrically connected to the memory circuit, and has a second path segment, which adjoins the first path segment and is electrically connected to the contact element, wherein both path segments are equipped with elements for providing a radio link between the first path segment and the second path segment.

2. The mechatronic locking system as claimed in claim 1, wherein the elements for the radio link are a resonant circuit comprising capacitor and inductor.

3. The mechatronic locking device as claimed in claim 1, wherein the second path segment is an electrically conducting physical connection from the elements for the radio link to the contact element.

4. The mechatronic locking device as claimed in claim 1, wherein the memory circuit of the security key comprises a chip having an associated resonant circuit, wherein the resonant circuit provides the first path segment of the contact path and the elements for the radio link, and the control circuit of the locking cylinder comprises a chip having an associated resonant circuit, wherein parts of said resonant circuit are arranged on the security key and are electrically connected to the contact element of the security key via the electrically conducting physical path, wherein said parts arranged on the security key provide the second path segment of the contact path and the elements for the radio link, and wherein with the security key inserted, the two contact elements are electrically in contact with one another, whereby data can be transferred between the security key and the locking cylinder via the resonant circuits.

5. The mechatronic locking system as claimed in claim 4, wherein the resonant circuit of the memory circuit of the security key comprises a capacitor and an inductor, wherein capacitor and inductor are arranged on the security key, and wherein the resonant circuit of the control circuit of the locking cylinder comprises a capacitor and an inductor, wherein the inductor is arranged on the security key in the region of the inductor of the resonant circuit of the memory circuit of the security key, and wherein the capacitor is arranged in the locking cylinder, wherein with key inserted, the resonant circuit is closed via the contact elements.

6. The mechatronic locking system as claimed in claim 4, wherein the resonant circuit of the memory circuit of the security key comprises a capacitor and an inductor, wherein capacitor and inductor are arranged on the security key, and wherein the resonant circuit of the control circuit of the locking cylinder comprises a capacitor and an inductor, wherein the inductor and the capacitor are arranged on the security key in the region of the inductor of the resonant circuit of the memory circuit of the security key, wherein with key inserted, the resonant circuit is connected to the chip via the contact elements.

7. The mechatronic locking system as claimed in claim 5, wherein the two inductors are arranged at a small separation apart, preferably at a separation of 0 to 10 mm, particularly preferably at a separation of 0.05 to 5 mm.

8. The mechatronic locking system as claimed in any claim 1, wherein the memory circuit of the security key has at least one further communication channel, wherein the further communication channel can be connected to a control circuit of a further device, in particular of a read/write device, preferably via an air interface.

9. The mechatronic locking system as claimed in claim 8, wherein the memory circuit, in particular the chip, comprises a first resonant circuit comprising a first inductor and a first capacitor, and a second resonant circuit comprising a second inductor and a second capacitor, wherein the first resonant circuit is connected to the contact element and hence provides said communication channel, and wherein the second resonant circuit together with the further device provides the further communication channel, or the memory circuit comprises a single resonant circuit that provides both communication channels.

10. The mechatronic locking system as claimed in claim 1 wherein the contact elements have two contact segments.

11. The mechatronic locking system as claimed in claim 1, wherein the inductor and capacitor are connected in a parallel or series arrangement to the respective chip.

12. The mechatronic locking system as claimed in claim 1, wherein the chip on the security key constitutes a transmitter, and the chip in the locking cylinder constitutes a receiver, wherein data can be transferred from the transmitter to the receiver via the communication channel and the associated contact path.

13. The mechatronic locking system as claimed in claim 1, wherein electrical power can be transmitted via the communication channel.

14. The mechatronic locking system as claimed in claim 6, wherein the two inductors are arranged at a small separation apart, preferably at a separation of 0 to 10 mm, particularly preferably at a separation of 0.05 to 5 mm.

* * * * *